United States Patent [19]

Ohashi

[11] Patent Number: 5,041,045

[45] Date of Patent: Aug. 20, 1991

[54] WIND INSTRUMENT TOY

[75] Inventor: Michiya Ohashi, Tokyo, Japan

[73] Assignee: Tomy Company, Ltd., Katsushika, Japan

[21] Appl. No.: 627,856

[22] Filed: Dec. 17, 1990

[30] Foreign Application Priority Data

Dec. 19, 1989 [JP] Japan ..... 1-146413

[51] Int. Cl.[5] ..... A63H 5/00

[52] U.S. Cl. ..... 446/178; 446/176

[58] Field of Search ..... 446/176, 178, 213, 218, 446/431, 457, 465, 489

[56] References Cited

U.S. PATENT DOCUMENTS 1,984,843 12/1934 Schoenfeld ..... 446/218
3,675,365 7/1972 Silva ..... 446/465 X
3,982,459 9/1976 Akiyama ..... 446/178 X
4,094,094 6/1978 Ono ..... 446/178

FOREIGN PATENT DOCUMENTS 475539 5/1915 France ..... 446/176

*Primary Examiner*—Roabert A. Hafer
*Assistant Examiner*—Sam Rimell
*Attorney, Agent, or Firm*—Staas & Halsey

[57] ABSTRACT

The present invention provides a wind instrument toy having a plurality of melody pipes played by air fed from a blower. A plurality of valves open and close vent portions of the melody pipes. A plurality of vent pipes connect to the corresponding vent portions of the melody pipes and have vertically movable floats therein which float on the air in accordance with music played.

19 Claims, 5 Drawing Sheets

WIND INSTRUMENT TOY

BACKGROUND OF THE INVENTION

1. Technical Field

The present invention relates to a wind instrument toy wherein a plurality of melody pipes different in the music scale are played by utilizing air fed from a blower.

2. Related Art

As shown in Japanese Patent Publication No. 27980/78 and corresponding United Kingdom Patent No. GB 2,040,096, the prior art contains a wind instrument toy including a blower, a plurality of melody pipes different in the music scale being played by air fed from the blower, opening/closing means for opening and closing vent portions of the melody pipes, and operating means for causing the opening/closing means to perform the opening and closing operations. The wind instrument toy plays a certain melody by controlling the air fed from the blower means to the vent portions of the melody pipes. of the melody pipes.

At the time when the above wind instrument toy was put on the market, it attracted children's attention widely because it was novel and fantastic. But over a long lapse of time, it can became less novel or fantastic and children might lose interest in the toy.

SUMMARY OF THE INVENTION

The present invention solves this problem by providing a wind instrument toy including blower means; a plurality of melody pipes different in the music scale, the melody pipes being played by air fed from the blower means; opening/closing means for opening and closing vent portions of the melody pipes; operating means for causing the opening/closing means to perform the opening and closing operations; a plurality of vent pipes for allowing air discharged from the melody pipes to flow upward; and vertically movable floats contained in the vent pipes, the floats capable of floating by the pressure of air passing through the vent pipes.

When the wind instrument toy of the present invention is played, the air discharged from each melody pipe flows into the corresponding vent pipe, and the float contained therein floats by the pressure of the air. Therefore, the floats provide an impression as if they were floating in accordance with the melody from the melody pipes.

The above-mentioned and other features of the present invention will now become apparent from the following description when read in conjunction with the accompanying drawings.

DESCRIPTION OF THE PREFERRED EMBODIMENT

Figure 1:
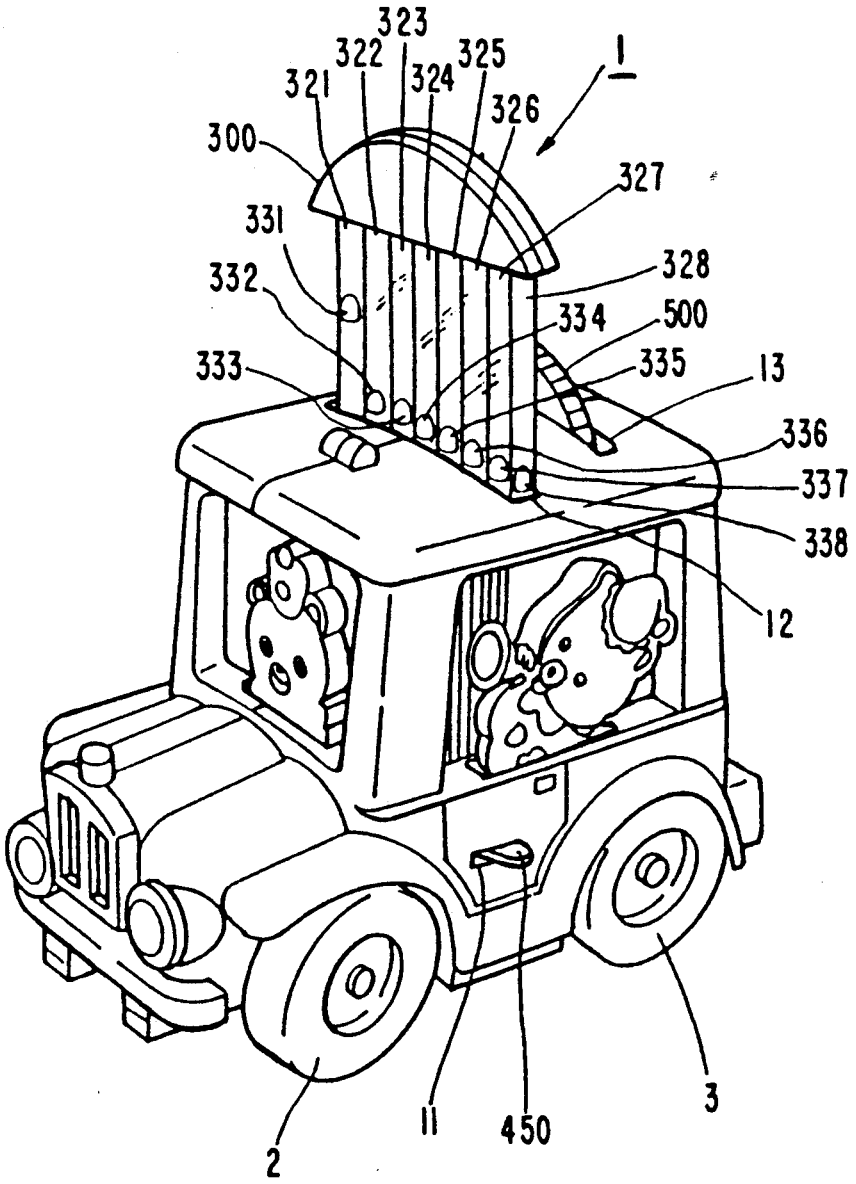
FIG. 1 is a perspective view of a wind instrument toy embodying the invention.

FIG. 1 is a perspective view of a wind instrument toy 1 according to an embodiment of the present invention. The wind instrument toy 1, which is in the form of a vehicle, on wheels 2 and 3, incorporates therein a wind instrument body which will later be described below.

On one side of the wind instrument toy 1 a change-over switch 450 projects through an opening 11 to turn ON and OFF a motor (later described) as a drive source which causes the wind instrument toy to run and play. A vent pipe unit 300 and a playing disc 500 upwardly project from the roof portion of the wind instrument respectively through openings 12 and 13. A springed member (not shown) can be used to hold the vent pipe unit 300 vertically upright. The springed member allows the vent pipe unit 300 to rock sightly out of position in the event a child bumps the vent pipe unit 300. The vent pipe unit 300 is provided with a plurality of vertically elongated and transparent vent pipes 321–328 containing vertically movable floats 331–338. The playing disc 500 is replaceable with other playing discs having different musical patterns.

When the change-over switch 450 is turned ON, the toy is allowed to run by a driving force of an internal motor (later described) and the playing disc 500 rotates, whereby the wind instrument plays the melody of a piece of music. The floats 331–338 in the vent pipes 321–328 float (rise) in accordance with the melody.

Figure 2:
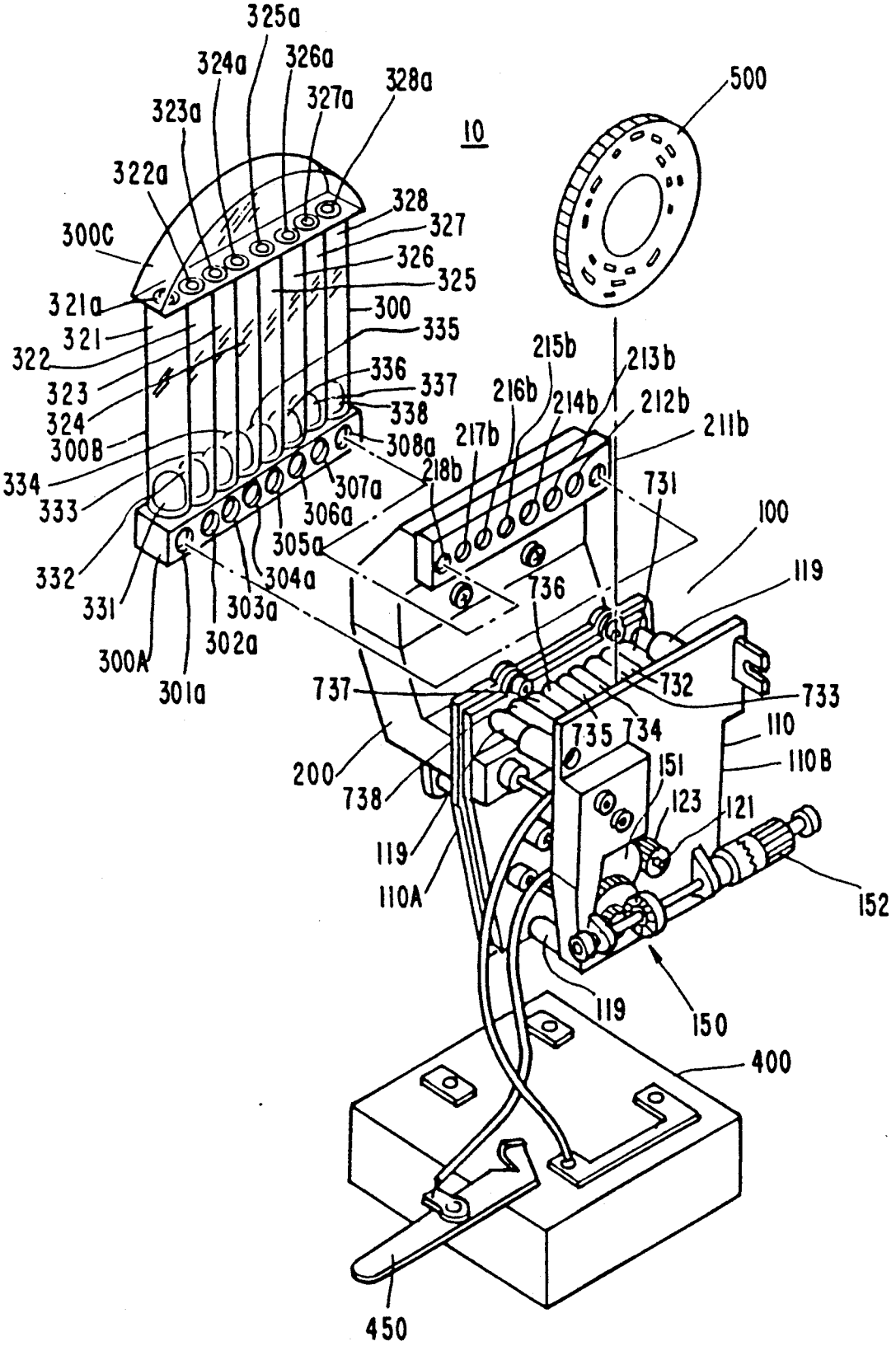
FIG. 2 is an exploded perspective view thereof.
Figure 3:
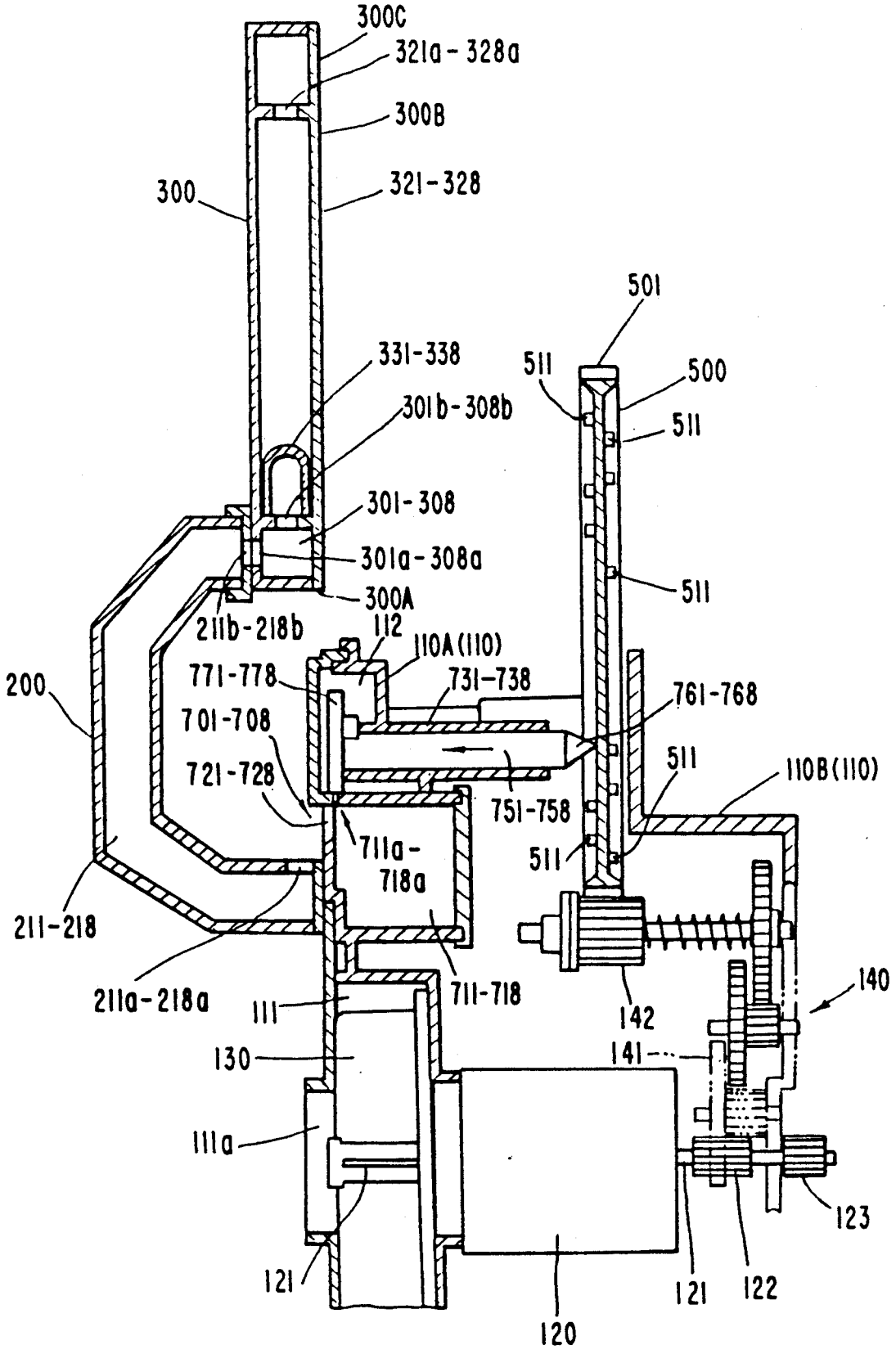
FIG. 3 is a vertical sectional view of a portion of the toy.

FIG. 2 is an exploded perspective view of a wind instrument body 10 incorporated into the wind instrument toy 1, and FIG. 3 is a partial side view of a vertical section thereof. As shown in FIGS. 2 and 3, the wind instrument body 10 is composed of a body unit 100, the vent pipe unit 300, and an operating board 400, and the playing disc 500. The vent pipe unit 300 is connected to the body unit 100 through a conduit unit 200. The operating board 400 turns ON and OFF a drive means mounted in the body unit 100. The playing disc 500 plays the melody of a certain piece of music on later-described melody pipes mounted in the body unit 100.

The wind instrument body unit 100 includes a body frame 110, a motor 120, a blast fan 130, a first gear group 140, a second gear group 150 and melody pipes 701 to 708. The body frame 110 is provided with the blast chamber and air chamber as later described. The blast fan 130 is rotated by the driving force of the motor 120 to provide air pressure to play the wind instrument. The first gear group 140 (FIG. 3) transfers the driving force of the motor 120 to the playing disc 400. The second gear group 150 (FIG. 2) transfers the driving force of the motor 120 to the wheel 3 (rear wheel). The eight melody pipes 701–708 represent the eight notes of a music scale. Chromatic scales and scales of different keys are possible as are multiple octive scales.

Figure 4:
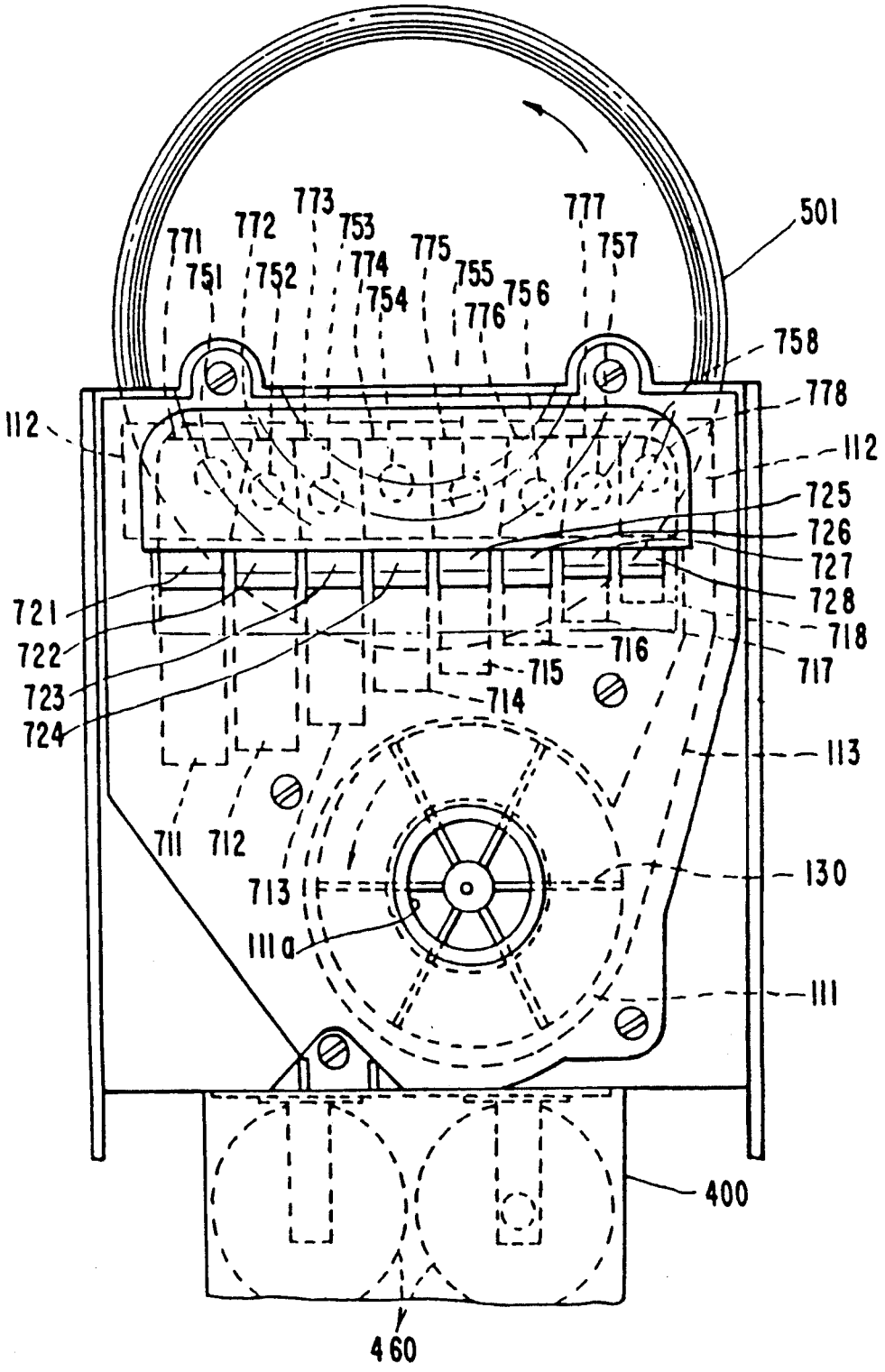
FIG. 4 is a partial front view in vertical sectional view of another portion of the toy.

As shown in FIG. 2, the body frame 110 is provided with a front frame 110A and a rear frame 110B integrally interconnected through tubular spacers 119. The front frame 110A is provided with a blast chamber 111, an air chamber 112, and eight resonance chambers 711–718. The blast chamber 111 accommodates the blast fan 130. The air chamber 112 communicates with the blast chamber 111 through a blast passage 113 (FIG. 4). The eight resonance chambers 711–718 communicate with the air chamber 112 through separate vent portions (vent holes) **711*a*–718*a*. In the upper portion of front walls of the resonance chambers 711–718, air outlets 721–728** are formed.

Above the resonance chambers 711–718, tubular guides 731–738 are laterally provided in a row as shown in FIG. 2. Pressure-slide members 751–758 are slidably received in the tubular guides 731–738 in a longitudinal direction. Rear end portions of the pressure-slide members 751–758 are formed with contacting projections 761–768, while front end portions thereof are provided with opening/closing members 771–778 for opening and closing the vent portions 711*a*–718*a*. The pressure-slide members 751–758 can slide between retreated positions and advanced positions. The retreated positions close the vent portions 711*a*–781*a* with the opening/closing members 717–787 and the advanced positions open the vent portions 711*a*–781*a*.

The motor 120 serves as drive means for driving the rear wheel 3, the blast fan 130 and the playing disc 500 and is mounted between the front frame 110A and the rear frame 110B. A driving shaft 121 of the motor 120 projects forward and backward as shown in FIG. 3.

The blast fan 130 introduces air from an air intake port 111*a* into the blast chamber 111 and feeds the air into the air chamber 112 through the blast passage 113. The blast fan 130 is fixed to the driving shaft 121 of the motor 120 in the blast chamber 111 of the front frame 110A. The blast fan is rotated by the driving force of the motor.

The first gear group 140 reduces the rotating speed of the motor 120 to rotate the playing disc 500. A first gear 141 meshes with a pinion gear 122 fixed onto the driving shaft 121 of the motor 120. A final gear 142 meshes with teeth 501 (rater described) formed on the outer peripheral edge of the playing disc 500. A second gear between the first and final gear can also be added.

The second gear group 150 is for reducing the rotative driving force of the motor 120 and transfer it to the rear wheel 3. A first gear 151 meshes with a pinion gear 123 (FIG. 3) fixed onto the driving shaft 121 of the motor 120. A final gear 152 meshes with a gear (not shown) on an inside perimeter of the wheel 3 on the right rear side.

The melody pipes 701–708 are composed of the resonance chambers 711–718, vent portions 711*a*–781*a* and air outlets 721–728. The vent portions 711*a*–718*a* are formed in the upper walls of the resonance chambers 711–718 in communication with the air chamber 112. The air outlets 721–728 are formed in the upper portions of the front walls of the resonance chambers 711–718. When the pressure-slide members 751–758 move into a retreated position to open the vent portions 711*a*–718*a*, the air in the air chamber 112 flows through the thus-opened vent portions 711*a*–718*a* into the resonance chambers 711–718 and produces pipe sounds. In this embodiment, eight melody pipes 701–708 are used to produce pipe sounds having an eight note musical scale.

The conduit pipe unit 200 separately introduces the air discharged from the air discharge ports 721–728 of the melody pipes 701–708 into the vent pipe 300. A base end portion of the conduit unit 200 attaches to the front-side lower portions of the melody pipes 701–708.

The conduit pipe unit 200 has eight conduits 211–218 corresponding to the eight melody pipes 701–708, the front end sides of the conduits 211–218 being bent and extending upward. In the upper walls of the base end portions of the conduits 211–218, intake ports 211*a*–218*a* receive the air discharged from the air outlets 721–728 of the melody pipes 701–708, while in the front end portions of the conduits 211–218, blast ports 211*b*–218*b* are formed for feeding air to the vent pipe unit 300. The vent pipe unit 300 allows visual recognition of playing conditions of melody pipes 701–708 and is mounted to the front end of the conduit unit 200.

The vent pipe unit 300 is composed of a connecting portion 300A connected to the front end of the conduit pipe unit 200, a vent pipe portion 300B erected on the connecting portion 300A and a communication chamber 300C provided on the vent pipe portion 300B.

The connecting portion 300A is divided into first through eighth vent compartments 301–308. In a side of the vent compartment 301–308 mounted to the conduit unit 200 are formed vent holes 301*a*–308*a* corresponding to the blast ports 211*b*–218*b* of the front end of the conduit unit 200. A screen can be placed over vent holes 301*a*–308*a*. In the upper portions of the vent compartments 301–308, vent holes 301*b*–308*b* are formed which communicate with the vent pipe portion 300B.

The vent pipe portion 300B is composed of eight vent pipes 321–328 erected on the connecting portion 300A. The vent pipes 321–328 are formed of a transparent material, and lowerend openings thereof are in communication with the vent compartments 301–308 of the connecting portion 300A through the vent holes 301*b*–308*b*, as shown in FIG. 3.

The vent pipes 321–328, respectively, contain vertically movable floats 331–338. The floats 331–338 are raised by air flowing into the vent pipes 321–328 through the vent compartments 301–308 and are each formed in the shape of a bowl having an opening which faces downward.

The communication chamber 300C serves as an air chamber for allowing air to flow freely through the vent pipes 321–328 from one pipe to another pipe. The communication chamber 300C and the vent pipes 321–328 allow flow of air between the ends of neighboring vent pipes. Baffles can be placed above the vent pipes so that air flows primarily between neighboring vent pipes. The inside diameter of communication holes 321*a*–328*a* for communication between upper-end openings of the vent pipes 321–328 and the communication chamber 300C is smaller than the outside diameter of the floats 331–338.

The operating board 400 turns ON and OFF the motor 120. Batteries 460 (FIG. 4) are contained inside the operating board 400 as a power source. On the upper side of the operating board, a change-over switch 450 is pivotably provided for turning ON and OFF the power source to respectively operate the motor 120 and stop the operation thereof.

The playing disc 500 rotates to move the pressure-slide members 751–758 forward to play the melody pipes 701–708 with a predetermined melody. The playing disc 500 is replaceable with other discs accommodated in a receptacle portion (not shown) provided on the front side of the rear frame 110B of the body frame 110. Throughout the outer peripheral edge of the playing disc 500 there are formed teeth 501 capable of meshing with the final gear 142 of the first gear group 140.

On the front and back surfaces of the playing disc 500 there are formed playing lugs 511 along circular paths having different distances $r_1$ to $r_8$ from the center. The playing lugs 511 move (slide) the pressure-slide members 751–758 forward in accordance with a predetermined melody to play the eight note music scale of melody pipes 701–708.

Figure 5:
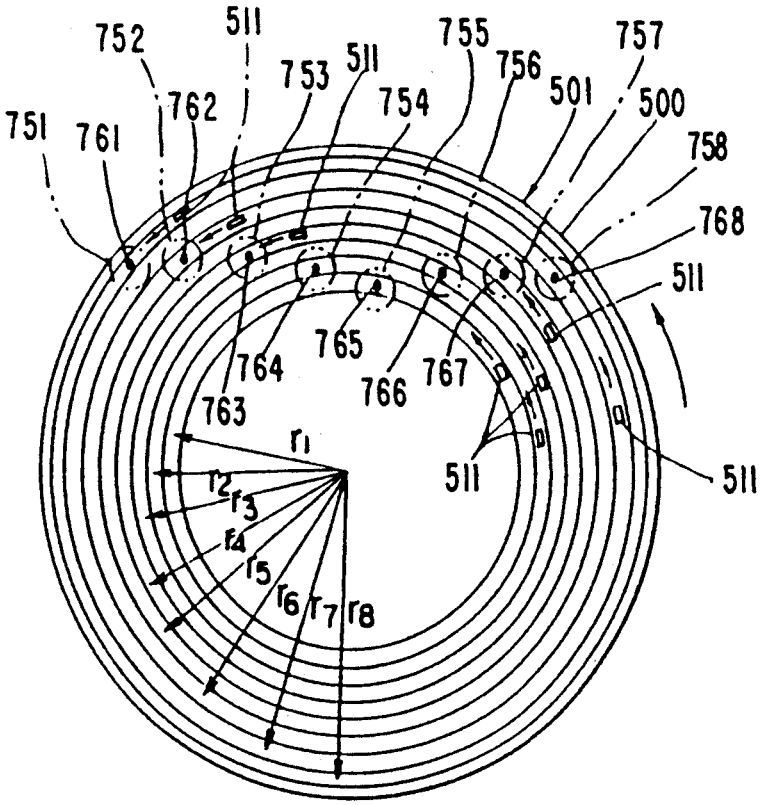
FIG. 5 is a plan view of a playing disc, showing the arrangement of the playing lugs on the playing disc and the pressure-slide members.

The following description is now provided with reference to FIG. 5. The playing lugs 511 formed on the playing disc 500 have a contacting relationship with the pressure-slide members 751–758. The pressure-slide members 751–758 move (slide) forward by the lugs 511 to play the eight note music scale of melody pipes 701–708 in accordance with the melody of a predetermined piece of music.

As shown in FIG. 5, the contacting projection 761 at the rear end of the pressure-slide member 751 of the melody pipe 701 which produces the sound "do" is in a position capable of contacting the playing lug 511 formed on the circumference of radius $r_8$. The contacting projection 762 at the rear end of the pressure-slide member 752 of the melody pipe 702 which produces the sound "re" is in a position capable of contacting the playing lug 511 formed on the circumference of radius $r_6$, and the contacting projection 763 at the rear end of the pressure-slide member 753 of the melody pipe 703 which produces the sound "mi" is in a position capable of contacting the playing lug 511 formed on the circumference of radius $r_4$. The contacting projection 764 at the rear end of the pressure-slide member 754 of the melody pipe 704 which produces the sound "fa" is in a position capable of contacting the playing lug 511 formed on the circumference of radius $r_2$, and the contacting projection 765 at the rear end of the pressure-slide member 755 of the melody pipe 705 which produces the sound "sol" is in a position capable of contacting the playing lug 511 formed on the circumference of radius $r_1$. Further, the contacting projection 766 at the rear end of the pressure-slide member 756 of the melody pipe 706 which produces the sound "la" is in a position capable of contacting the playing lug 511 formed on the circumference of radius $r_3$; the contacting projection 767 at the rear end of the pressure-slide member 757 of the melody pipe 707 which produces the sound "ti" is in a position capable of contacting the playing lug 511 formed on the circumference of radius $r_5$, and the contacting projection 768 at the rear end of the pressure-slide member 758 of the melody pipe 708 which produces the sound "do" is in a position capable of contacting he playing lug 511 formed on the circumference of radius $r_7$.

On the other hand, the playing lugs 511 on the playing disc 500 are arranged in the order of playing the eight note music scale of melody pipes 701–708 in accordance with the melody of a predetermined piece of music.

In the wind instrument toy 1 of this embodiment constructed as above, when the motor 120 is turned ON by operating the change-over switch 450, the driving force of the motor is transferred to the wheel 3 (rear wheel) by the second transfer gear group 150, whereby the wheel 3 is rotated. At the same time, the blast fan 130 is rotated in the counterclockwise direction as illustrated in FIG. 4 by the driving force of the motor 120, and with this rotation, air is introduced into the blast chamber 111 from the air intake port 111*a*. The air taken in by blast chamber 111 is fed into the air chamber 112 through the blast passage 113, and the resulting air pressure acts against the front faces of the opening/closing portions 771–778 at the front ends of the pressure-slide members 751–758 and thereby moves the pressure-slide members into the retreated position. As a result, the vent portions 711*a*–718*a* are closed with the opening/closing portions 771–778 formed at the front ends of the pressure-slide members 751–758, so none of the melody pipes 701–708 are in play.

In this state, if the playing disc 500 is received into a receptacle portion (not shown) provided on the front side of the rear frame 110B of the body frame 110, the rotative driving force of the motor 120 is exerted on the playing disc 500 through the first gear group 140, and the playing disc 500 is thereby rotated slowly in the counterclockwise direction as seen from the front side.

With the rotation of the playing disc 500, the playing lugs 511 formed on the front side of the disc come into abutment with the contacting projections 761–768 formed at the rear ends of the pressure-slide members 751–758 and thereby move the pressure-slide members forward. With this movement, the vent portions 711*a*–718*a* of the corresponding melody pipes 701–708 are opened, so that the air in the air chamber 712 flows through the thus-opened vent portions 711*a*–781*a* into the resonance chambers 711*a*–718*a*. The eight note music scale of melody pipes 701–708 are thus played in accordance with the melody of a piece of music specified by the arrangement of the playing lugs 511 on the front face of the playing disc 500.

While the melody pipes 701–708 are played, the air discharged from the air discharge ports 712–782 of the resonance chambers 711–718 enters the conduits 211–218 through the air intake ports 211*a*–281*a* and then flows into the vent pipes 211–218 through the conduits 211–218 and the vent chambers 301–308. The floats 331–338 are pushed up by the air which has entered the vent pipes 211–218. Thus, the floats 331–338 contained in the vent pipes 211–218 are raised (floated) while providing an impression as if they were floated in accordance with the melody from the melody pipes 701–708. Consequently, the wind instrument toy 1 becomes more interesting.

Although in the above embodiment the wind instrument toy 1 is formed in an external shape of an automobile, it may be formed in any other desired shape, e.g., an animal shape. Further, although the vent pipe unit 300 was attached to the wind instrument body 10 through the conduit unit 200, there may be adopted a direct mounting structure.

As set forth above, the wind instrument toy of the present invention includes blower; a plurality of melody pipes different in the music scale, the melody pipes being played by air fed from the blower; opening/closing means for opening and closing vent portions of the melody pipes; operating means for causing the opening/closing means to perform the opening and closing operations; a plurality of vent pipes for allowing air discharged from the melody pipes to flow upward; and floats contained in the vent pipes vertically movably, the floats being floated by the pressure of air passing through the vent pipes. In this construction, the air discharged from the melody pipes as the wind instrument toy is played flows into the vent pipes corresponding to the melody pipes and the floats in the vent pipes are floated by the pressure of such inflow air while providing an impression as if they were floating in accordance with the melody of a piece of music from the melody pipes. Consequently, the wind instrument toy becomes more interesting.

While the invention has been illustrated and described in detail in the drawings and foregoing description, it will be recognized that many changes and modifications will occur to those skilled in the art. It is therefore intended, by the appended claims, to cover any such changes and modifications as fall within the true spirit and scope of the invention.

What is claimed is:

1. A wind instrument toy comprising:

a blast fan;

a plurality of melody pipes, each of said melody pipes having an air outlet;

a plurality of valves controllably disposed between said blast fan and said melody pipes, each of said valves correspondingly associated with one of said melody pipes;

a plurality of vent pipes, each of said vent pipes having a first end coupled to an air outlet of a corresponding melody pipe; and a plurality of vertically movable floats, each of said floats contained within a corresponding vent pipe.

2. A wind instrument toy according to claim 1, further comprising:

a plurality of conduits, each conduit operatively connected from an air outlet of a melody pipe to a corresponding vent pipe.

3. A wind instrument toy according to claim 2, further comprising:

a coupler detachably connecting said vent pipes to said conduits.

4. A wind instrument toy according to claim 3, wherein said vent pipes are formed of optically transparent material.

5. A wind instrument toy according to claim 3, further comprising:

crossover vents disposed between neighboring vent pipes at second ends of said vent pipes.

6. A wind instrument toy according to claim 3, further comprising:

a plurality of slide members, each of said slide members disposed within one of said valves with an outwardly urging force.

7. A wind instrument toy according to claim 6, wherein each said melody pipe includes a resonance chamber.

8. A wind instrument toy according to claim 6, wherein said toy further comprises a disc driving mechanism rotatably connected to said blast fan; and wherein said plurality of slide members are cooperatively arranged with respect to said disc driving mechanism.

9. A wind instrument toy according to claim 8, further comprising:

a plurality of wheels movably connected to support said toy.

10. A wind instrument toy according to claim 9, further comprising:

a gear group operatively coupled from said blast fan to at least one of said wheels.

11. A wind instrument toy according to claim 1, further comprising:

a plurality of slide members, each of said slide members disposed within one of said valves with an outwardly urging force.

12. A wind instrument toy according to claim 11, wherein said toy further comprises a disc driving mechanism rotatably connected to said blast fan; and wherein said plurality of slide members are cooperatively arranged with respect to said disc driving mechanism.

13. A wind instrument toy according to claim 11, further comprising:

a plurality of wheels movably connected to support said toy.

14. A wind instrument toy according to claim 13, further comprising:

a gear group operatively coupled from said blast fan to at least one of said wheels.

15. A wind instrument toy according to claim 1, further comprising:

a plurality of wheels movably connected to support said toy.

16. A wind instrument toy according to claim 15, further comprising:

a gear group operatively coupled from said blast fan to at least one of said wheels.

17. A wind instrument toy according to claim 16, further comprising:

a plurality of conduits, each of said conduits operatively connected from an air outlet of a melody pipe to a corresponding vent pipe.

18. A wind instrument toy according to claim 17, further comprising:

couplers detachably connecting said vent pipes to said conduits.

19. A wind instrument toy according to claim 1, further comprising:

a communication chamber having openings disposed against a second end of each of said vent pipes.

* * * * *

UNITED STATES PATENT AND TRADEMARK OFFICE

CERTIFICATE OF CORRECTION

PATENT NO. : 5,041,045

DATED : August 20, 1991

INVENTOR(S) : Michiya Ohashi

It is certified that error appears in the above-identified patent and that said Letters Patent is hereby corrected as shown below:

On title page item [56] FOREIGN PATENT DOCUMENTS insert the following:

--2040096 Great Britain--.

Col. 2, line 14, after "instrument" insert --1--.

Col. 4, line 23, change "lowerend" to --lower-end--.

Signed and Sealed this

Twenty-second Day of December, 1992

*Attest:*

DOUGLAS B. COMER

*Attesting Officer*

*Acting Commissioner of Patents and Trademarks*